US012134844B2

(12) United States Patent
Poruthoor et al.

(10) Patent No.: US 12,134,844 B2
(45) Date of Patent: Nov. 5, 2024

(54) NONWOVEN WEB WITH INCREASED CD STRENGTH

(71) Applicant: Kimberly-Clark Worldwide, Inc., Neenah, WI (US)

(72) Inventors: Simon K. Poruthoor, Alpharetta, GA (US); Karen Goeders, Atlanta, GA (US); Allen F. Vater, Alpharetta, GA (US); Bryan D. Haynes, Jasper, GA (US); April Montoya Vaverka, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 319 days.

(21) Appl. No.: 17/786,658

(22) PCT Filed: Dec. 18, 2019

(86) PCT No.: PCT/US2019/067139

§ 371 (c)(1),
(2) Date: Jun. 17, 2022

(87) PCT Pub. No.: WO2021/126188

PCT Pub. Date: Jun. 24, 2021

(65) Prior Publication Data

US 2023/0067631 A1 Mar. 2, 2023

(51) Int. Cl.
*D04H 1/56* (2006.01)
*D04H 1/26* (2012.01)

(52) U.S. Cl.
CPC ..... *D04H 1/56* (2013.01); *D04H 1/26* (2013.01)

(58) Field of Classification Search
CPC ..... D04H 1/565; D04H 1/56; D04H 1/732; B32B 5/08; B32B 5/268
(Continued)

(56) References Cited

U.S. PATENT DOCUMENTS 3,485,706 A * 12/1969 Evans ..... D04H 1/495 162/204
3,849,241 A * 11/1974 Butin ..... D01D 5/0985 428/137

(Continued)

FOREIGN PATENT DOCUMENTS

CN 101065521 A 10/2007
CN 101978107 A 2/2011
CN 102791914 A 11/2012

OTHER PUBLICATIONS

Ghosh, Rounak et al., "Studies on tensile properties of cross-laid needle-punched non-woven polyester fabric", International Journal of Scientific & Engineering Research, https://www.ijser.org/researchpaper/Studies-on-tensile-properties-of-cross-laid-needle-punched-non-woven-polyester-fabric.pdf.

(Continued)

*Primary Examiner* — Jillian K Pierorazio

(57) ABSTRACT

The present invention discloses a nonwoven web and methods for manufacturing the nonwoven web. One aspect of the invention includes a plurality of outwardly facing nozzles that are positioned at various angles with respect to the axis of a pipe the nozzles are located on. Another aspect of the invention pertains to perturbing at least a portion of a fiber matrix prior to the fiber matrix collecting on a forming surface. The perturbed fiber matrix provides for an increase in cross-machine direction fiber strength of the nonwoven web.

19 Claims, 4 Drawing Sheets

(58) Field of Classification Search
USPC ..... 264/177.17
See application file for complete search history.

(56) References Cited

U.S. PATENT DOCUMENTS

| | | | | |
|---|---|---|---|---|
| 4,991,264 | A | 2/1991 | Greenway et al. | |
| 5,151,320 | A | 9/1992 | Homonoff et al. | |
| 5,667,749 | A | 9/1997 | Lau et al. | |
| 6,417,120 | B1 * | 7/2002 | Mitchler | D04H 1/56 428/326 |
| 6,932,929 | B2 * | 8/2005 | Krautkramer | A61F 13/534 264/177.17 |
| 7,897,240 | B2 | 3/2011 | Noda et al. | |
| 8,461,066 | B2 | 6/2013 | Robertson et al. | |
| 9,408,761 | B2 | 8/2016 | Xu et al. | |
| 9,457,538 | B2 * | 10/2016 | Smith | B32B 5/26 |
| 9,820,895 | B2 | 11/2017 | Xu et al. | |
| 9,993,369 | B2 | 6/2018 | Xu et al. | |
| 2003/0150090 | A1 * | 8/2003 | Krautkramer | D04H 1/56 28/158 |
| 2005/0148261 | A1 * | 7/2005 | Close | D04H 5/06 442/381 |
| 2007/0045905 | A1 * | 3/2007 | Venturino | D04H 1/43835 425/81.1 |
| 2007/0045906 | A1 * | 3/2007 | Daniels | D04H 1/732 425/81.1 |
| 2009/0151748 | A1 * | 6/2009 | Ridenhour | B32B 5/26 428/220 |
| 2010/0178456 | A1 | 7/2010 | Kuroda et al. | |
| 2015/0021805 | A1 * | 1/2015 | Henderson | D04H 1/732 264/103 |
| 2015/0322601 | A1 * | 11/2015 | Brown | D04H 1/56 425/72.2 |
| 2016/0101003 | A1 | 4/2016 | Jennewein et al. | |
| 2016/0355950 | A1 * | 12/2016 | Young | D01F 11/00 |
| 2017/0002486 | A1 * | 1/2017 | Castillo | B32B 5/08 |
| 2017/0281428 | A1 | 10/2017 | Mueller et al. | |
| 2017/0306540 | A1 * | 10/2017 | Poruthoor | D04H 1/425 |
| 2018/0002846 | A1 | 1/2018 | Novarino et al. | |
| 2018/0051404 | A1 | 2/2018 | Novarino et al. | |
| 2020/0157717 | A1 * | 5/2020 | Haynes | D01D 5/0985 |
| 2022/0364284 | A1 * | 11/2022 | Zampollo | B32B 5/028 |
| 2023/0321571 | A1 * | 10/2023 | Platt | B32B 37/12 55/488 |

OTHER PUBLICATIONS

Ghosh, Rounak et al., "Studies on tensile properties of cross-laid needle-punched non-woven polyester fabric", International Journal of Scientific & Engineering Research, May 2019, https://www.ijser.org/researchpaper/Studies-on-tensile-properties-of-cross-laid-needle-punched-non-woven-polyester-fabric.pdf.

* cited by examiner

NONWOVEN WEB WITH INCREASED CD STRENGTH

BACKGROUND OF THE DISCLOSURE

The production of nonwoven fabrics has long used meltblown, coform and other techniques to produce webs for use in forming a wide variety of products. Coform nonwoven webs, which are composites of a matrix of meltblown fibers and an absorbent material (e.g., pulp fibers), have been used as an absorbent layer in a wide variety of applications, including absorbent articles, absorbent dry wipes, wet wipes, and mops. Most conventional coform webs employ meltblown fibers formed from polypropylene homopolymers. One problem sometimes experienced with such coform materials, however, is that the polypropylene meltblown fibers do not readily bond to the absorbent material. Thus, to ensure that the resulting web is sufficiently strong, a relatively high percentage of meltblown fibers are typically employed to enhance the degree of bonding at the crossover points of the meltblown fibers. Unfortunately, the use of such a high percentage of meltblown fibers may have an adverse affect on the resulting absorbency of the coform web. Another problem sometimes experienced with conventional coform webs relates to the ability to form a textured surface. For example, a textured surface may be formed by contacting the meltblown fibers with a foraminous surface having three-dimensional surface contours. With conventional coform webs, however, it is sometimes difficult to achieve the desired texture due to the relative inability of the meltblown fibers to conform to the three-dimensional contours of the foraminous surface.

As such, a need exists for an improved nonwoven web for use in a variety of applications. Accordingly, it is an object of the present invention to provide a nonwoven web that includes a higher portion of cross-machine direction (CD) fibers which increases CD strength of the nonwoven web.

SUMMARY OF THE INVENTION

Generally, the present invention relates to improvements for making a nonwoven web by forming meltblown and coform nonwoven webs. More specifically, the present invention relates to a nonwoven web that includes a forming surface that is located in the machine-direction (MD). Additionally, first and second meltblown die heads are disposed at angles above the forming surface that includes a first gas stream being extruded from the first meltblown die head and a second gas stream being extruded from the second meltblown die head. Further, a pulp nozzle is disposed above and perpendicular to the forming surface. The pulp nozzle includes a third gas stream that is between the first and the second gas streams. The first, second and third gas streams merge to form a fiber matrix. The apparatus for making the nonwoven web also includes a plurality of pipes that are above the forming surface and orientated in a parallel plane with the forming surface. The plurality of pipes have a plurality of nozzles. The plurality of nozzles include outwardly facing angles. A fourth gas stream is connected with one or more ends of the plurality of pipes and is discharged through the outwardly facing angled plurality of nozzles in the cross-machine direction (CD). After the fourth gas stream is discharged through the plurality of nozzles, perturbation of the fiber matrix in the CD is undertaken before contacting the forming surface. Surprisingly and unexpectedly, it was found that the nonwoven web formed by the aforementioned apparatus effectively increases CD strength of the nonwoven web.

In a further embodiment of the invention, a method of manufacturing a nonwoven web is disclosed. The method provides for a forming surface that travels in a MD. The method also includes a first and a second meltblown die heads that are disposed above and at an angle to the forming surface. The method further includes extruding a first and second gas stream that includes a plurality of polymeric fibers from the first and second meltblown die heads, respectively. The present method also includes a third gas stream that has a plurality of absorbent fibers that are located between the first and the second gas streams. The first, second and third gas streams are then merged into a fiber matrix. The method further includes a fourth gas stream that is adjacent to the forming surface. The fourth gas stream travels toward the CD. The fourth gas stream contacts the fiber matrix and perturbs at least a portion of the fiber matrix fibers to yield a perturbed fiber matrix. The perturbed matrix fibers are then collected onto the forming surface to form a nonwoven web.

In another embodiment of the invention, a nonwoven web that has an overall increased CD/MD fiber strength is disclosed. More specifically, the nonwoven web includes a plurality of fibers that have at least about 30 percent nonwoven fibers that have a cross-machine direction orientation. The nonwoven web has a MD/CD Tensile Ratio less than about 2.0.

DEFINITIONS

Figure 1:
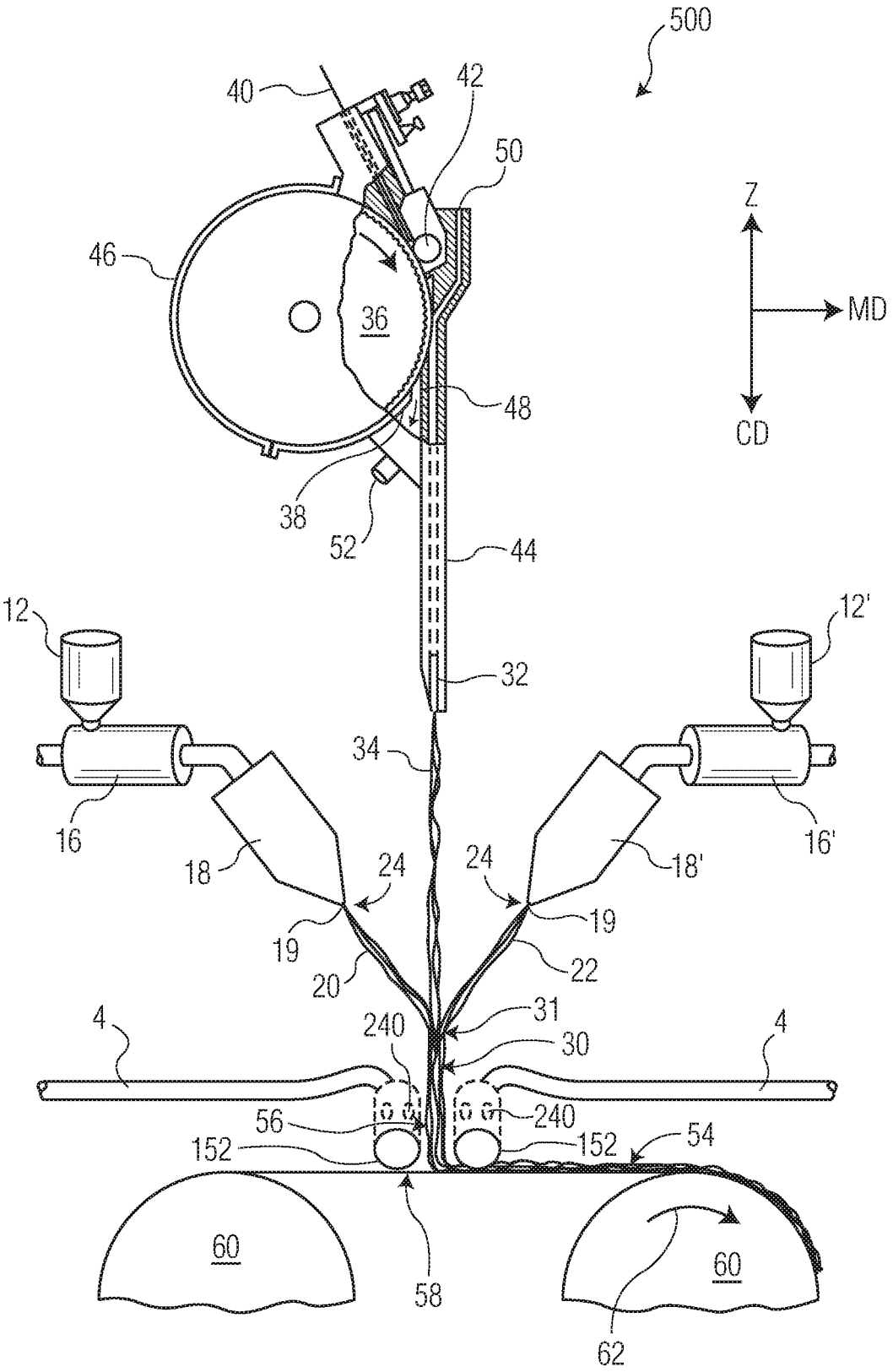
FIG. 1 is a schematic illustrating one embodiment of a method for manufacturing a nonwoven web of the present invention.

When introducing elements of the present disclosure or the preferred embodiment(s) thereof, the articles "a", "an", and "the" when used herein are intended to mean that there are one or more of the elements.

The terms "comprising", "including" and "having" when used herein are intended to be inclusive and mean that there may be additional elements other than the listed elements.

The term "nonwoven web" when used herein refers to a web having a structure of individual fibers or threads which are interlaid, but not in an identifiable manner as in a knitted fabric. Examples of suitable nonwoven fabrics or webs include, but are not limited to, meltblown webs, spunbond webs, bonded carded webs, airlaid webs, coform webs, hydraulically entangled webs, and so forth.

The term "meltblown" when used herein refers to a nonwoven web that is formed by a process in which a molten thermoplastic material is extruded through a plurality of fine, usually circular, die capillaries as molten fibers into converging high velocity gas (e.g., air) streams that attenuate the fibers of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin, et al., which is incorporated herein in its entirety by reference thereto for all purposes. Generally speaking, meltblown fibers may be microfibers that are substantially continuous or discontinuous, generally smaller than 10 micrometers in diameter, and generally tacky when deposited onto a collecting surface.

The term "fluid" when used herein means any liquid or gaseous medium; however, in general the preferred fluid is a gas and more particularly air.

The term "plurality" when used herein refers to one or more.

The term "perturbation" when used herein means a small to moderate change from the steady flow of fluid, or the like, for example up to 50 percent of the steady flow, and not having a discontinuous flow to one side.

The term "tensile strength" when used herein refers to a measure of the ability of a material to withstand a longitudinal stress, expressed as the greatest stress that the material can stand without breaking. Tensile strength is expressed in grams per unit of force (gf).

The term "MD/CD tensile ratio" when used herein refers to the machine-direction fiber tensile strength divided by the cross-machine direction tensile strength.

The term "resin" when used herein refers to any type of liquid or material which may be liquefied to form fibers or nonwoven webs, including without limitation, polymers, copolymers, thermoplastic resins, waxes and emulsions.

DETAILED DESCRIPTION

The embodiments of the present invention allow one to use a technique to draw fiber into a nonwoven web formed with little or no interruption of the production process. The technique involves perturbing a gas stream from a plurality of pipes that are orientated above and in a parallel plane with the forming surface. Accordingly, perturbation of the present invention may be implemented in melt-blown and coforming processes, but is not limited to those processes.

As previously mentioned, it was found surprisingly and unexpectedly that the nonwoven web formed herein effectively increases cross-machine direction (CD) tensile strength of the nonwoven web. More specifically, an increase in CD tensile strength in the nonwoven web may be attributed to the reorientation of fibers prior to formation on a forming surface. Tensile strength used herein to measure the CD peak load number ranges, as disclosed in Table 1, was at about 108 psi at a flow rate of 100 cubic feet per minute. Another aspect of increasing CD tensile strength in the nonwoven web may be attributed to a gas stream (or air flow stream) traveling through the plurality of pipes toward outwardly facing nozzles (or holes) to yield a fiber matrix that is perturbed at an angle with respect to the axis of the pipe the nozzles are located. The perturbed CD fiber matrix is then collected on a forming surface to form a nonwoven web with increased CD fiber strength. Accordingly, the nonwoven webs disclosed herein tend to exhibit greater CD strengths (the MD is the direction of movement, relative to the forming die, of the substrate on which the web is formed; the CD is perpendicular to the MD). Additionally, by providing nonwoven fibers in the CD, there are many more points of contact with the nonwoven fibers in both the CD and MD, thus, enhancing overall nonwoven web strength. Further, the nonwoven web includes pulp fibers, CD fibers and MD fibers. The pulp fibers do not contribute to the overall fiber strength. Accordingly, the nonwoven web has a CD Tensile Strength of at least about 10% greater compared to a substantially similar web prepared without perturbation of the fiber matrix immediately prior to the collecting step.

Referring to FIG. 1, one embodiment of a process is shown for making a nonwoven web of the present invention. In this embodiment, the apparatus includes a pellet hopper 12 or 12' of an extruder 16 or 16', respectively, into which a polymer thermoplastic composition may be introduced. The extruders 16 and 16' each have an extrusion screw (not shown), which is driven by a conventional drive motor (not shown). As the polymer advances through the extruders 16 and 16', it is progressively heated to a molten state due to rotation of the extrusion screw by the drive motor. Heating may be accomplished in a plurality of discrete steps with its temperature being gradually elevated as it advances through discrete heating zones of the extruders 16 and 16' toward two meltblowing die heads 18 and 18', respectively. The meltblowing die heads 18 and 18' may be yet another heating zone where the temperature of the thermoplastic resin is maintained at an elevated level for extrusion.

When two or more meltblowing die heads are used, such as described above, it should be understood that the fibers produced from the individual die heads may be different types of fibers. That is, one or more of the size, shape, or polymeric composition may differ, and furthermore the fibers may be monocomponent or multicomponent fibers. For example, larger fibers may be produced by the first meltblowing die head, such as those having an average diameter of about 10 micrometers or more, in some embodiments about 15 micrometers or more, and in some embodiments, from about 20 to about 50 micrometers, while smaller fibers may be produced by the second die head, such as those having an average diameter of about 10 micrometers or less, in some embodiments about 7 micrometers or less, and in some embodiments, from about 2 to about 6 micrometers. In addition, it may be desirable that each die head extrude approximately the same amount of polymer such that the relative percentage of the basis weight of the coform nonwoven web material resulting from each meltblowing die head is substantially the same. Alternatively, it may also be desirable to have the relative basis weight production skewed, such that one die head or the other is responsible for the majority of basis weight of the nonwoven web. As a specific example, for a meltblown fibrous nonwoven web material having a basis weight of 34 grams per square meter (gsm), it may be desirable for the first meltblowing die head to produce about 30 percent of the basis weight of the meltblown fibrous nonwoven web material, while one or more subsequent meltblowing die heads produce the remainder 70 percent of the basis weight of the meltblown fibrous nonwoven web material. Generally speaking, the overall basis weight of the nonwoven web, preferably coform, is from about 20 gsm to about 350 gsm and the pertubed fiber matrix (fibers in the CD) has a basis weight from about 20 gsm to about 100 gsm.

Each meltblowing die head 18 and 18' is configured so that two streams of attenuating gas per die converge to form a single stream of gas which entrains and attenuates molten threads 19 as they exit small holes or orifices 24 in each meltblowing die head. The molten threads 19 are formed into fibers or, depending upon the degree of attenuation, microfibers, of a small diameter which is usually less than the diameter of the orifices 24. Thus, each meltblowing die head 18 and 18' has a corresponding single stream of a first gas 20 and a second gas 22. The gas streams 20 and 22 containing polymer fibers are aligned to converge at an impingement zone 31. Typically, the meltblowing die heads 18 and 18' are arranged at a certain angle with respect to the forming surface, such as described in U.S. Pat. Nos. 5,508,102 and 5,350,624 to Georger et al. Additionally, each die head 18 and 18' is set at an angle ranging from about 30 to about 75 degrees, in some embodiments from about 35 degrees to about 60 degrees, and in some embodiments from about 45 degrees to about 55 degrees. The die heads 18 and 18' may be oriented at the same or different angles. In fact, the texture of the nonwoven web may actually be enhanced by orienting one die at an angle different than another die.

Referring again to FIG. 1, absorbent fibers 32 (e.g., pulp fibers) are added at the impingement zone 31 along with the first gas stream 20 and the second gas stream 22. Introduction of the absorbent fibers 32 into the two streams 20 and 22 of thermoplastic polymer fibers 30 is designed to produce a graduated distribution of absorbent fibers 32 within the combined gas streams 20 and 22 of thermoplastic polymer fibers 30. This may be accomplished by merging a third gas stream 34 containing the absorbent fibers 32 between the two gas streams 20 and 22 of thermoplastic polymer fibers 30 so that all three gas streams converge in a controlled manner. Because they remain relatively tacky and semi-molten after formation, the thermoplastic polymer fibers 30 may simultaneously adhere and entangle with the absorbent fibers 32 upon contact therewith to form a coherent nonwoven web.

To accomplish the merger of the fibers, any conventional equipment may be employed, such as a picker roll 36 arrangement having a plurality of teeth 38 adapted to separate a mat or batt 40 of absorbent fibers into the individual absorbent fibers. When employed, the sheets or mats 40 of fibers 32 are fed to the picker roll 36 by a roller arrangement 42. After the teeth 38 of the picker roll 36 have separated the mat of fibers into separate absorbent fibers 32, the individual fibers are conveyed toward the stream of thermoplastic polymer fibers through a pulp nozzle 44. A housing 46 encloses the picker roll 36 and provides a passageway or gap 48 between the housing 46 and the surface of the teeth 38 of the picker roll 36. A gas, for example, air, is supplied to the passageway or gap 48 between the surface of the picker roll 36 and the housing 46 by way of a gas duct 50. The gas duct 50 may enter the passageway or gap 48 at the junction 52 of the nozzle 44 and the gap 48. The gas is supplied in sufficient quantity to serve as a medium for conveying the absorbent fibers 32 through the pulp nozzle 44. The gas supplied from the duct 50 also serves as an aid in removing the absorbent fibers 32 from the teeth 38 of the picker roll 36. The gas may be supplied by any conventional arrangement such as, for example, an air blower (not shown). It is contemplated that additives and/or other materials may be added to or entrained in the gas stream to treat the absorbent fibers. The individual absorbent fibers 32 are typically conveyed through the pulp nozzle 44 at about the velocity at which the absorbent fibers 32 leave the teeth 38 of the picker roll 36. In other words, the absorbent fibers 32, upon leaving the teeth 38 of the picker roll 36 and entering the nozzle 44, generally maintain their velocity in both magnitude and direction from the point where they left the teeth 38 of the picker roll 36. Such an arrangement, which is discussed in more detail in U.S. Pat. No. 4,100,324 to Anderson, et al.

If desired, the velocity of the third gas stream 34 may be adjusted to achieve nonwoven webs of different properties. For example, when the velocity of the third gas stream is adjusted so that it is greater than the velocity of each stream 20 and 22 containing entrained thermoplastic polymer fibers 30 upon contact at the impingement zone 31, the absorbent fibers 32 are incorporated in the nonwoven web in a gradient structure. That is, the absorbent fibers 32 have a higher concentration between the outer surfaces of the nonwoven web than at the outer surfaces. On the other hand, when the velocity of the third gas stream 34 is less than the velocity of the first gas stream 20 and the second gas stream 22 thermoplastic polymer fibers 30 upon contact at the impingement zone 31, the absorbent fibers 32 are incorporated in the nonwoven web in a substantially homogenous fashion. That is, the concentration of the absorbent fibers is substantially the same throughout the nonwoven web. This is because the low-speed stream of absorbent fibers is drawn into a high-speed stream of thermoplastic polymer fibers to enhance turbulent mixing which results in a consistent distribution of the absorbent fibers.

To convert the composite stream 56 of thermoplastic polymer fibers 30 and absorbent fibers 32 into a nonwoven web 54, a collecting device is located in the path of the composite stream 56. The collecting device may be a forming surface 58 (e.g., belt, drum, wire, fabric, etc.) driven by rollers 60 and that is rotating as indicated by the arrow 62 in FIG. 1. The merged streams of thermoplastic polymer fibers and absorbent fibers are collected as a coherent matrix of fibers on the surface of the forming surface 58 to form the nonwoven web 54. If desired, a vacuum box (not shown) may be employed to assist in drawing the near molten meltblown fibers onto the forming surface 58.

FIG. 1 also introduces a plurality of pipes 152. For illustrative purposes, FIG. 1 shows two pipes 152 that are positioned above the forming surface 58 and orientated in a parallel plane with the forming surface 58. There may be two, three, four, five, six, eight, ten or even up to twenty pipes that may form a plurality of pipes 152. Each pipe in the plurality of pipes 152 may be constructed of any type of plastic, metal, steel or combination thereof. The plurality of pipes 152 are located above and orientated in a parallel plane with the forming surface so as to perturb the fiber matrix 56 such that a portion of the fiber matrix 56 in the nonwoven web 54 are reoriented, i.e., the MD/CD ratio is altered. The length of each pipe is dependent on the overall width of the forming apparatus 500. Each pipe may be of the same length or different lengths but the pipe lengths should be as long as the widths of the overall forming apparatus 500. Furthermore, a fourth gas stream may be attached or connected by a tube (or hose) 4 at one or both ends of one or more pipes 152. The fourth gas stream 4 may include air or nitrogen, oxygen or a similar gas thereof.

FIG. 1 further depicts a plurality of nozzles 240 that are outwardly facing holes. Each nozzle has a thickness that is dependent on the wall thickness of each pipe. Further, the plurality of nozzles 240 are in fluid communication with the fourth gas stream via the plurality of pipes 152. In other words, the fourth gas stream may enter one or more plurality of pipes 152 at one or both ends of the plurality of pipes 152 through a tube 4. The fourth gas stream exits the plurality of pipes 152 through the plurality of nozzles 240.

The plurality of nozzles 240 may be located from about 1.0 cm, 2.0 cm, 2.5 cm, 5.0 cm, 7 cm, 9 cm, 12 cm, 14 cm, 15 cm or 20 cm from the base of the forming surface 58. The plurality of nozzles 240 may be located at the same or at different heights from the base of the forming surface 58, i.e. one nozzle may be at 2.5 cm and another nozzle may be at 15 cm from the base of the forming surface 58. The base is defined herein as the top portion of the forming surface.

Each nozzle (or hole) in the plurality of nozzles 240 is separated from each other at intervals that may range from about 1 cm, 2 cm, 3 cm, or 4 cm's along the circumference of each pipe. Additionally, each nozzle has a diameter from about 0.5 mm to about 5.0 mm. More preferably, the diameter of each nozzle is from about 1 mm to about 3 mm's. Further, along the circumference of the pipe each nozzle is separated by about ten cm's.

Figure 2:
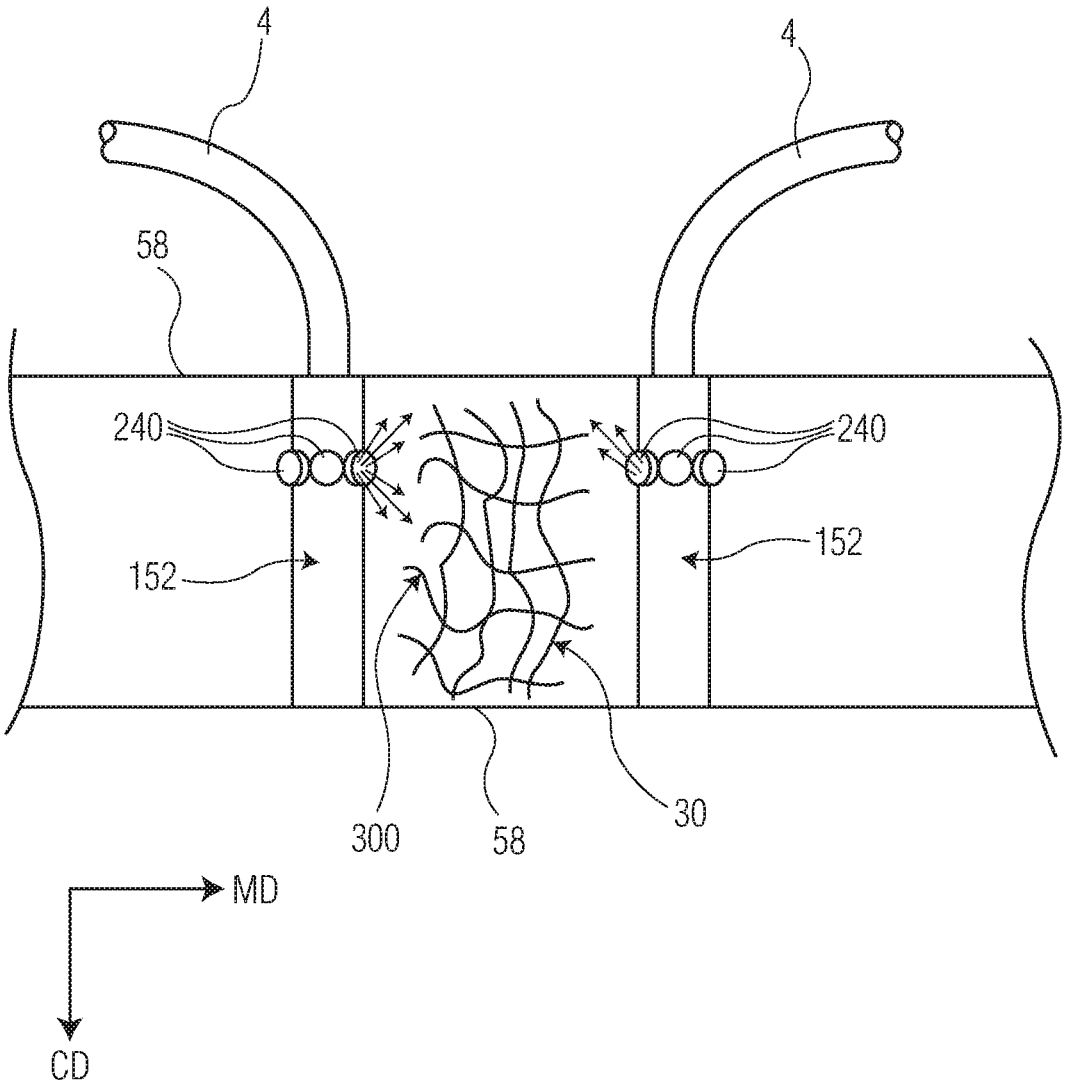
FIG. 2 is a top view of the method shown in FIG. 1 depicting the textured nonwoven web formed according to the present invention.

FIG. 2 shows a top view of the process for making a nonwoven web as depicted in FIG. 1. As disclosed in FIG. 2, the plurality of nozzles 240 are orientated at varying angles to the forming surface 58 and orientated to provide a fourth gas stream 4 traveling in a substantially CD to the MD of the forming surface 58. More specifically, the forming surface 58 has an upper surface lying in an upper surface plane and the plurality of nozzles 240 are orientated in a parallel plane with the upper surface plane. FIG. 2 also shows the nonwoven fibers in the CD 30 and the nonwoven fibers in the MD 300 on the forming surface 58.

Figure 3:
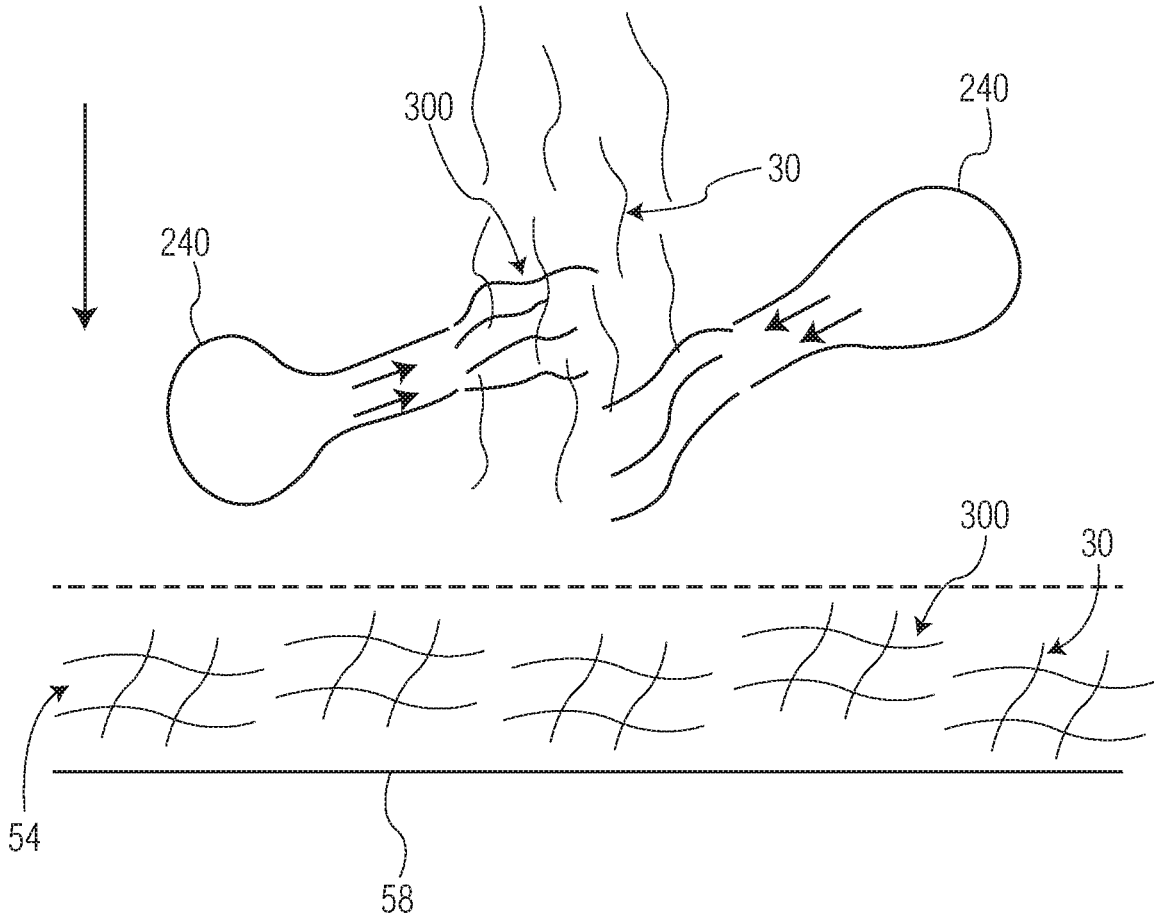
FIG. 3 is a schematic illustrating cross-machine direction air flow coming from two angled nozzles wherein the air flow travels in the same direction.

FIG. 3 shows a perspective view of two nozzles 240 in the CD wherein air flow is coming out of the nozzle in an opposite angled direction with respect to the axis of the pipe the nozzles are located on. The air flow travels in the same direction. FIG. 3 further shows the nonwoven fibers in the CD 30 and MD 300 directions prior to touching the forming surface as well as when both nonwoven fibers are on the forming surface 58 to make a nonwoven web 54.

Figure 4:
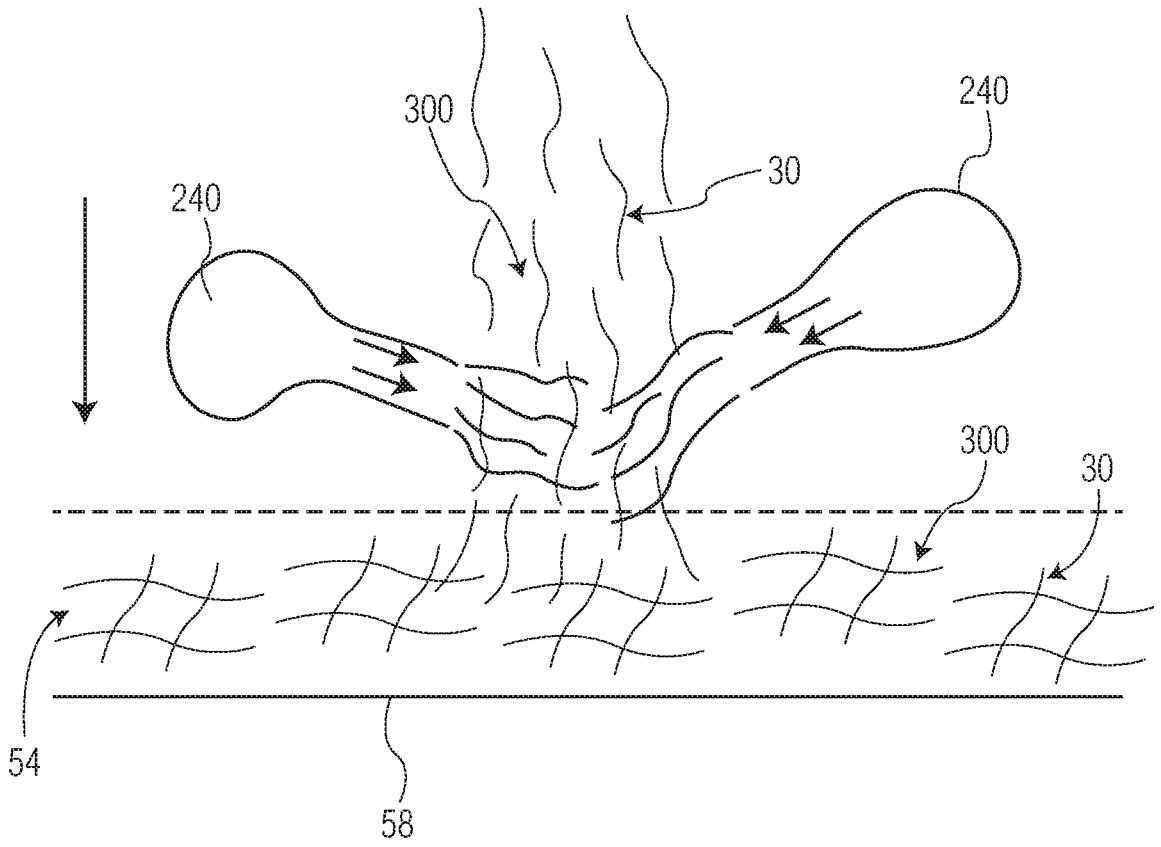
FIG. 4 is a schematic illustrating cross-machine direction air flow coming from two angled nozzles wherein the air flow travels in different directions.

FIG. 4 depicts a view of two nozzles 240 in the CD wherein air flow is coming out of the nozzle in the same angled direction with respect to the axis of the pipe the nozzles are located on. The air flow travels in different directions. FIG. 4 further shows the nonwoven fibers in the CD 30 and MD 300 directions prior to touching the forming surface as well as when both nonwoven fibers are on the forming surface 58 to make a nonwoven web 54.

In view of FIGS. 3 and 4, each nozzle may be orientated at angles from about 15 degrees to 45 degrees wherein angles at 15, 30 or 45 degrees with respect to the axis of the pipe the nozzles are located on are preferred. Or each nozzle may be orientated at angles from about 195 to about 225 wherein angles from 195, 210 or 225 degrees with respect to the axis of the pipe the nozzles are located on are preferred. Or from about 315 to about 345 degrees wherein 315, 330 or 345 degrees with respect to the axis of the pipe the nozzles are located on are preferred. The forming surface has an upper surface lying in an upper surface plane and the nozzle or plurality of nozzles are orientated in a plane parallel with the upper surface plane.

Furthermore, each nozzle along each pipe may be at the same angle as disclosed above. For example, the plurality of nozzles 240 along the pipe may all be at 15 degree angles. Or, the plurality of nozzles 240 may all be at 30 or 45 degree angles. Or the plurality of nozzles 240 may all be at 195 degree angles. Or the plurality of nozzles 240 may all be at 210 or 225 degree angles with respect to the axis of the pipe the nozzles are located on.

Alternatively, the plurality of nozzles 240 along each pipe may be pointing at different angle directions. For example, one or more nozzles may be at 45 degree angles and one or more nozzles may be at 315 degree angles with respect to the axis of the pipe the nozzles are located on. Or, one or more nozzles may be at 30 degree angles and one or more nozzles may be at 330 degree angles. Alternatively, one or more nozzles may be at 15 degree angles and one or more nozzles may be at 345 degree angles. Or one or more nozzles may be at 45 degree angles and one or more nozzles may be at 315 degree angles. The angled nozzles on each pipe allow for nonwoven fibers to collect on the forming surface in the CD. Accordingly, FIG. 2 shows nonwoven fibers in both the CD 30 and MD 300. More specifically, FIG. 2 shows the nonwoven fibers in both CD 30 and MD 300 as a basket-weave like fiber connectivity. The resulting nonwoven web is coherent and may be removed from the forming surface 58 as a self-supporting nonwoven web.

It should be understood that the present invention is by no means limited to the above-described embodiments. In an alternative embodiment, for example, first and second melt-blowing die heads may be employed that extend substantially across a forming surface in a direction that is substantially transverse to the direction of movement of the forming surface. The die heads may likewise be arranged in a substantially vertical disposition, i.e., perpendicular to the forming surface. so that the thus-produced meltblown fibers are blown directly down onto the forming surface. Such a configuration is well known in the art and described in more detail in, for instance, U.S. Patent Application Publication No. 2007/0049153 to Dunbar, et al. Furthermore, although the above-described embodiments employ multiple melt-blowing die heads to produce fibers of differing sizes, a single die head may also be employed. An example of such a process is described, for instance, in U.S. Patent Application Publication No. 2005/0136781 to Lassig, et al., which is incorporated herein in its entirety by reference thereto for all purposes.

In one aspect of the invention, the nonwoven fibers disclosed herein may be monocomponent or multicomponent. Monocomponent fibers are generally formed from a polymer or blend of polymers extruded from a single extruder. Multicomponent fibers are generally formed from two or more polymers (e.g., bicomponent fibers) extruded from separate extruders. The polymers may be arranged in substantially constantly positioned distinct zones across the cross-section of the fibers. The components may be arranged in any desired configuration, such as sheath-core, side-by-side, pie, island-in-the-sea, three island, bull's eye, or various other arrangements known in the art. Various methods for forming multicomponent fibers are described in U.S. Pat. No. 4,789,592 to Taniguchi et al. and U.S. Pat. No. 5,336,552 to Strack et al., U.S. Pat. No. 5,108,820 to Kaneko, et al., U.S. Pat. No. 4,795,668 to Kruege, et al., U.S. Pat. No. 5,382,400 to Pike, et al., U.S. Pat. No. 5,336,552 to Strack, et al., and U.S. Pat. No. 6,200,669 to Marmon, et al., which are incorporated herein in their entirety by reference thereto for all purposes. Multicomponent fibers having various irregular shapes may also be formed, such as described in U.S. Pat. No. 5,277,976 to Hogle, et al., U.S. Pat. No. 5,162,074 to Hills, U.S. Pat. No. 5,466,410 to Hills, U.S. Pat. No. 5,069,970 to Largman, et al., and U.S. Pat. No. 5,057,368 to Largman, et al., which are incorporated herein in their entirety by reference thereto for all purposes.

In another aspect of the invention, any absorbent material such as absorbent fibers, particles, etc. may generally be employed through a pulp nozzle 44. The absorbent material includes fibers formed by a variety of pulping processes, such as kraft pulp, sulfite pulp, thermomechanical pulp, etc. The pulp fibers may include softwood fibers having an average fiber length of greater than 1 mm and particularly from about 2 to 5 mm based on a length-weighted average. Such softwood fibers may include, but are not limited to, northern softwood, southern softwood, redwood, red cedar, hemlock, pine (e.g., southern pines), spruce (e.g., black spruce), combinations thereof, and so forth. Exemplary commercially available pulp fibers suitable for the present invention include those available from Weyerhaeuser Co. of Federal Way, Wash. under the designation "Weyco CF-405" Hardwood fibers, such as eucalyptus, maple, birch, aspen, and so forth, can also be used. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste. Further, other natural fibers can also be used in the present invention, such as abaca, sabai grass, milkweed floss, pineapple leaf, and so forth. In addition, in some instances, synthetic fibers may also be utilized.

Besides or in conjunction with pulp fibers, the absorbent material may also include a superabsorbent that is in the form fibers, particles, gels, etc. Generally speaking, superabsorbents are water-swellable materials capable of absorbing at least about 20 times its weight and, in some cases, at least about 30 times its weight in an aqueous solution containing 0.9 weight percent sodium chloride. The superabsorbent may be formed from natural, synthetic and modified natural polymers and materials. Examples used herein may include superabsorbent particles used as a cross-linked terpolymer of acrylic acid (AA), methylacrylate (MA) and a small quantity of an acrylate/methacrylate monomer. Alternatively, examples of synthetic superabsorbent polymers that may be used herein include the alkali metal and ammonium salts of poly(acrylic acid) and poly(methacrylic acid), poly(acrylamides), poly(vinyl ethers), maleic anhydride copolymers with vinyl ethers and alpha-olefins, poly(vinyl pyrrolidone), poly(vinylmorpholinone), poly(vinyl alcohol), and mixtures and copolymers thereof. Further, superabsorbents include natural and modified natural polymers, such as hydrolyzed acrylonitrile-grafted starch, acrylic acid grafted starch, methyl cellulose, chitosan, carboxymethyl cellulose, hydroxypropyl cellulose, and the natural gums, such as alginates, xanthan gum, locust bean gum and so forth. Mixtures of natural and wholly or partially synthetic superabsorbent polymers may also be useful in the present invention. Particularly suitable superabsorbent polymers are HYSORB 8800AD (BASF of Charlotte, N.C. and FAVOR SXM 9300 (available from Degussa Superabsorber of Greensboro, N.C.).

In an additional aspect of the invention, the nonwoven web of the present invention is generally made by a process in which at least one meltblown die head (e.g., two) is arranged near a chute through which the absorbent material is added while the web forms. Some examples of such techniques are disclosed in U.S. Pat. No. 4,100,324 to Anderson, et al., U.S. Pat. No. 5,350,624 to Georger, et al.; and U.S. Pat. No. 5,508,102 to Georger, et al., as well as U.S. Patent Application Publication Nos. 2003/0200991 to Keck, et al. and 2007/0049153 to Dunbar, et al., all of which are incorporated herein in their entirety by reference thereto for all purposes.

Additionally, it may be desired in certain cases to form a nonwoven web that is textured. Referring again to FIG. 1, for example, one embodiment of the present invention employs a forming surface 58 that is foraminous in nature so that the fibers may be drawn through the openings of the surface and form dimensional cloth-like tufts projecting from the surfaces of the material that correspond to the openings in the forming surface 58. The foraminous surface may be provided by any material that provides sufficient openings for penetration by some of the fibers, such as a highly permeable forming surface. Surface weave geometry and processing conditions may be used to alter the texture or tufts of the material. The particular choice will depend on the desired peak size, shape, depth, surface tuft "density" (that is, the number of peaks or tufts per unit area), etc. In one aspect, for example, the surface may have an open area of from about 35 percent and about 65 percent, in some embodiments from about 40 percent to about 60 percent, and in some embodiments, from about 45 percent to about 55 percent. One exemplary high open area forming surface is the forming surface FORMTECH™ 6 manufactured by Albany International Co. of Albany, N.Y. Such a surface has a "mesh count" of about six strands by six strands per square inch (about 2.4 by 2.4 strands per square centimeter), i.e., resulting in about 36 foramina or "holes" per square inch (about 5.6 per square centimeter), and therefore capable of forming about 36 tufts or peaks in the material per square inch (about 5.6 peaks per square centimeter). The FORMTECH™ 6 surface also has a warp diameter of about 1 millimeter polyester, a shute diameter of about 1.07 millimeters polyester, a nominal air permeability of approximately 41.8 $m^3$/min (1475 $ft^3$/min), a nominal caliper of about 0.2 centimeters (0.08 inch) and an open area of approximately 51 percent. Another exemplary forming surface available from the Albany International Co. is the forming surface FORMTECH™ 10, which has a mesh count of about 10 strands by 10 strands per square inch (about 4 by 4 strands per square centimeter), i.e., resulting in about 100 foramina or "holes" per square inch (about 15.5 per square centimeter), and therefore capable of forming about 100 tufts or peaks per square inch (about 15.5 peaks per square centimeter) in the material. Still another suitable forming surface is FORMTECH™ 8, which has an open area of 47 percent and is also available from Albany International. Of course, other forming wires and surfaces (e.g., drums, plates, etc.) may be employed. Also, surface variations may include, but are not limited to, alternate weave patterns, alternate strand dimensions, release coatings (e.g., silicones, fluorochemicals, etc.), static dissipation treatments, and the like. Still other suitable foraminous surfaces that may be employed are described in U.S. Patent Application Publication No. 2007/0049153 to Dunbar, et al.

Furthermore, the nonwoven web may be used in a wide variety of articles. For example, the web may be incorporated into an "absorbent article" that is capable of absorbing water or other fluids. Examples of some absorbent articles include, but are not limited to, personal care absorbent articles, such as diapers, pant diapers, open diapers, training pants, absorbent underpants, incontinence articles, feminine hygiene products (e.g., sanitary napkins), swim wear, baby wipes, mitt wipe, and so forth; medical absorbent articles, such as garments, fenestration materials, underpads, bedpads, bandages, absorbent drapes, and medical wipes; food service wipers; clothing articles; pouches, and so forth. Materials and processes suitable for forming such articles are well known to those skilled in the art.

Test Methods:

Tensile Strength:

The tensile strength was measured in accordance with STM-00254. The test method is used to test for peak load stretch on 25.4 mm wide strips of wet or dry wipe material.

Fiber Orientation:

Fiber orientation is a critical parameter that affect the mechanical properties of the final composite. Selecting the suitable fiber structure mainly depends on the loading condition, whether it is uniaxial, biaxial, shear, or impact state of stress. Fiber orientation influences the structural behavior of fiber-filled parts. When fibers are added peak loads are influenced by fiber orientation and loading direction. This is illustrated in the tensile strength test in accordance with STM-00254 as shown in Table 1.

Thermal Properties:

The melting temperature, crystallization temperature, and crystallization half time were determined by differential scanning calorimetry (DSC) in accordance with ASTM D-3417. The differential scanning calorimeter was a DSC Q100 Differential Scanning calorimeter, which was outfitted with a liquid nitrogen cooling accessory and with a UNIVERSAL ANALYSIS 2000 (version 4.6.6) analysis software program, both of which are available from T.A. Instruments Inc. of New Castle, Del. To avoid directly handling the samples, tweezers or other tools were used. The samples were placed into an aluminum pan and weighed to an accuracy of 0.01 milligram on an analytical balance. A lid was crimped over the material sample onto the pan. Typically, the resin pellets were placed directly in the weighing pan, and the fibers were cut to accommodate placement on the weighing pan and covering by the lid.

The differential scanning calorimeter was calibrated using an indium metal standard and a baseline correction was performed, as described in the operating manual for the differential scanning calorimeter. A material sample was placed into the test chamber of the differential scanning calorimeter for testing, and an empty pan is used as a reference. All testing was run with a 55-cubic centimeter per minute nitrogen (industrial grade) purge on the test chamber. For resin pellet samples, the heating and cooling program was a 2-cycle test that began with an equilibration of the chamber to −25 degrees centigrade, followed by a first heating period at a heating rate of 10 degrees centigrade per minute to a temperature of 200 degrees centigrade, followed by equilibration of the sample at 200 degrees centigrade for 3 minutes, followed by a first cooling period at a cooling rate of 10 degrees centigrade per minute to a temperature of −25 degrees centigrade, followed by equilibration of the sample at −25 degrees centigrade for 3 minutes, and then a second heating period at a heating rate of 10 degrees centigrade per minute to a temperature of 200 degrees centigrade All testing was run with a 55-cubic centimeter per minute nitrogen (industrial grade) purge on the test chamber. The results were then evaluated using the UNIVERSAL ANALYSIS 2000 analysis software program, which identified and quantified the melting and crystallization temperatures.

The half time of crystallization was separately determined by melting the sample at 200 degrees centigrade for 5 minutes, quenching the sample from the melt as rapidly as possible in the DSC to a preset temperature, maintaining the sample at that temperature, and allowing the sample to crystallize isothermally. Tests were performed at two different temperatures—i.e., 125 degrees centigrade and 130 degrees centigrade. For each set of tests, heat generation was measured as a function of time while the sample crystallized. The area under the peak was measured and the time which divides the peak into two equal areas was defined as the half-time of crystallization. In other words, the area under the peak was measured and divided into two equal areas along the time scale. The elapsed time corresponding to the time at which half the area of the peak was reached was defined as the half-time of crystallization. The shorter the time, the faster the crystallization rate at a given crystallization temperature.

Table/Example

The following tables and example are provided solely for the purpose of illustrating how nozzle angles effect fiber matrix peak loads in the CD and should not be interpreted as limiting the scope of the invention as set forth in the claims.

TABLE 1

| Nozzle angles with respect to the axis of the pipe the nozzles are located on | Nozzle Angle Direction with respect to the axis of the pipe the nozzles are located on | CD Peak Load Range (gf) |
|---|---|---|
| 45 and 315 degrees | Pointing in different directions of each other | 425-600 |
| 30 and 330 degrees | Pointing in different directions of each other | 600-675 |
| 15 and 345 degrees | Pointing in different directions of each other | 525-650 |
| 45 or 225 degrees | Pointing in same direction of each other | 500-575 |
| 30 or 210 degrees | Pointing in same direction of each other | 510-650 |
| 15 or 195 degrees | Pointing in same direction of each other | 425-610 |

Table 1 shows cross-machine direction (CD) peak load ranges when air at 100 cubic feet per minute and a pressure of 108 psi is introduced into a plurality of pipes. In one test the nozzles were positioned at 15, 30 and 45 degree angles with respect to the axis of the pipe the nozzles are located on. In another separate test, the nozzles were positioned at both 15, 30 and 45 degree angles and at 345, 330 and 315 degree angles with respect to the axis of the pipe the nozzles are located on.

As shown in Table 1, the CD peak load for the 30 and 330 degree angle nozzles presented the optimal peak load and thus the most preferred nozzle angle directions on the pipes.

EXAMPLE

Impact of Basis Weight: Polylactic Acid (PLA) Polymer
Polymer Throughput: 0.5 GHM
Melt Temperature: 470 F
Basis Weight of perturbed fiber matrix: 80 gsm
Height from the Forming surface to the pipe nozzles: 5 cm
Process Conditions
Die Tip Geometry: Recessed
Die Width=20"
Gap=0.070"
Primary Airflow: Heated (470 F in heater)
100 cfm
Auxiliary Airflow: Unheated (ambient air temp.)
Pipe Inlet Pressure=108 psi Test Results The above configuration and results provide a baseline comparison of a typical melt-blown production run with continuous air flow into a plurality of pipes. A basis weight of 80 gsm for the perturbed fiber matrix was achieved while using the PLA polymer in combination with a plurality of nozzles on two pipes at both 30 and 210 degree angles with respect to the axis of the pipe the nozzles are located on.

First Embodiment: In a first embodiment the invention provides for a method for manufacturing a nonwoven web, the method comprising:

a. providing a forming surface traveling in a machine direction and lying in forming surface plane;
b. providing a first and a second meltblown die head disposed above and at an angle to the forming surface;
c. extruding a first gas stream comprising a plurality of polymeric fibers from the first meltblown die head;

d. extruding a second gas stream comprising a plurality of polymeric fibers from the second meltblown die head;
e. providing a pulp nozzle disposed above and perpendicular to the forming surface;
f. providing a third gas stream through the pulp nozzle positioned between the first and the second gas streams;
g. merging the first, second and third gas streams into a fiber matrix;
h. providing a plurality of nozzles adjacent to the forming surface and orientated to provide a fourth gas stream traveling at an angle relative to the machine direction;
i. providing the fourth gas stream through the plurality of nozzles, wherein the fourth gas stream contacts the fiber matrix and perturbs at least a portion of the fiber matrix fibers to yield a perturbed fiber matrix; and
j. collecting the perturbed fiber matrix on the forming surface to form a nonwoven web.

The method according to the preceding embodiment, wherein the plurality of nozzles comprise a plurality of holes radially disposed about the circumference of a pipe.

The method according to the preceding embodiments, wherein the fourth gas stream is air.

The method according to the preceding embodiments, wherein the nonwoven web has a CD Tensile Strength at least about 10% greater compared to a substantially similar web prepared without perturbation of the fiber matrix immediately prior to the collecting step.

The method according to the preceding embodiments, wherein the forming surface has an upper surface lying in an upper surface plane and the plurality of nozzles are orientated in a plane parallel with the upper surface plane.

The method according to the preceding embodiments, wherein the perturbed fiber matrix has a pressure of 108 pounds per square inch.

The method according to the preceding embodiments, wherein the perturbed fiber matrix yields a flow rate of 100 cubic feet per minute.

The method according to the preceding embodiments, wherein the plurality of nozzles are orientated at an angle from about 15 to about 225 degrees with respect to the axis of the pipe the nozzles are located on.

The method according to the preceding embodiments, wherein one or more nozzles are orientated at different directions to each other.

The method according to the preceding embodiments, wherein one or more nozzles are orientated at an angle from about 15 to about 45 degrees and one or more nozzles are orientated at an angle from about 315 to about 345 degrees with respect to the axis of the pipe the nozzles are located on.

The method according to the preceding embodiments, wherein each nozzle along the circumference of each pipe is separated by about ten centimeters.

The method according to the preceding embodiments, wherein the plurality of nozzles are located from about 2.5 centimeters to about 15 centimeters from the base of the forming surface.

The method according to the preceding embodiments, wherein each nozzle is spaced apart at intervals from about 1 centimeter to about 4 centimeters along the circumference of each pipe.

The method according to the preceding embodiments, wherein each nozzle has a diameter from about 0.5 millimeters to about 5 millimeters.

The method according to the preceding embodiments, wherein the perturbed fiber matrix has a basis weight from about 20 grams per square meter to about 100 grams per square meter.

Second Embodiment: In a second embodiment the invention provides for a nonwoven a plurality of fibers, wherein at least about 30 percent of the nonwoven fibers have a cross-machine direction orientation and the nonwoven web has MD/CD Tensile Ratio less than about 2.0.

The nonwoven web according to the preceding embodiment, wherein at from about 30 to about 50 percent of the fibers have a cross-machine direction orientation.

The nonwoven web according to the second embodiment, wherein the plurality of nonwoven fibers comprise fibers selected from the group consisting of superabsorbent particles used as a cross-linked terpolymer of acrylic acid (AA), methylacrylate (MA) and a small quantity of an acrylate/methacrylate monomer, synthetic superabsorbent polymers, natural and modified natural polymers, mixtures of natural and wholly or partially synthetic superabsorbent polymers and mixtures and copolymers thereof.

The nonwoven web according to the second embodiment, wherein the plurality of fibers have a MD/CD Tensile Ratio ranging from about 1 to about 2.

The nonwoven web according to the second embodiment, wherein the nonwoven web is used in an absorbent article.

What is claimed is:

1. A method of manufacturing a nonwoven web, wherein the method comprises:
a. providing a forming surface traveling in a machine direction and lying in forming surface plane;
b. providing a first and a second meltblown die head disposed above and at an angle to the forming surface;
c. extruding a first gas stream comprising a plurality of polymeric fibers from the first meltblown die head;
d. extruding a second gas stream comprising a plurality of polymeric fibers from the second meltblown die head;
e. providing a pulp nozzle disposed above and perpendicular to the forming surface;
f. providing a third gas stream through the pulp nozzle positioned between the first and the second gas streams;
g. merging the first, second and third gas streams into a fiber matrix;
h. providing a plurality of nozzles adjacent to the forming surface and orientated to provide a fourth gas stream traveling towards the cross-machine direction;
i. providing the fourth gas stream through the plurality of nozzles, wherein the fourth gas stream contacts the fiber matrix and perturbs at least a portion of the fiber matrix fibers to yield a perturbed fiber matrix; and
j. collecting the perturbed fiber matrix on the forming surface to form a nonwoven web.

2. The method according to claim 1, wherein the plurality of nozzles comprise a plurality of holes radially disposed about the circumference of a pipe.

3. The method according to claim 2, wherein the plurality of nozzles are orientated at an angle from about 15 to 225 degrees with respect to the axis of the pipe the nozzles are located on.

4. The method according to claim 2, wherein one or more nozzles are orientated at an angle from 15 to 45 degrees and one or more nozzles are orientated at an angle from 315 to 345 degrees with respect to the axis of the pipe the nozzles are located on.

5. The method according to claim 2, wherein each nozzle along the circumference of each pipe is separated by ten centimeters.

6. The method according to claim 2, wherein each nozzle is spaced apart at intervals from 1 centimeter to 4 centimeters along the circumference of each pipe.

7. The method according to claim 1, wherein the fourth gas stream is air.

8. The method according to claim 1, wherein the nonwoven web has a CD Tensile Strength at least 10% greater compared to a substantially similar web prepared without perturbation of the fiber matrix immediately prior to the collecting step.

9. The method according to claim 1, wherein the forming surface has an upper surface lying in an upper surface plane and the plurality of nozzles are orientated in a plane parallel with the upper surface plane.

10. The method according to claim 1, wherein the perturbed fiber matrix has a pressure of 108 pounds per square inch.

11. The method according to claim 1, wherein the perturbed fiber matrix yields a flow rate of 100 cubic feet per minute.

12. The method according to claim 1, wherein one or more nozzles are orientated at different directions to each other.

13. The method according to claim 1, wherein the plurality of nozzles are located from 2.5 centimeters to 15 centimeters from the base of the forming surface.

14. The method according to claim 1, wherein each nozzle has a diameter from 0.5 millimeters to 5 millimeters.

15. The method according to claim 1, wherein the perturbed fiber matrix has a basis weight from 20 grams per square meter to 100 grams per square meter.

16. The method according to claim 1, wherein at least 30 percent of the nonwoven fibers have a cross-machine direction orientation and the nonwoven web has MD/CD Tensile Ratio less than 2.0.

17. The method according to claim 1, wherein at from 30 to 50 percent of the fibers in the nonwoven web have a cross-machine direction orientation.

18. The method according to claim 1, wherein the nonwoven web has a MD/CD Tensile Ratio ranging from 1 to 2.

19. The method according to claim 1, wherein the nonwoven web is used in an absorbent article.

* * * * *